US005700160A

United States Patent [19]

Lee

[11] Patent Number: 5,700,160

[45] Date of Patent: Dec. 23, 1997

[54] ELECTRICAL CONNECTOR FOR INTERCONNECTING FEMALE AND MALE CONTACTS OF CABLES

[75] Inventor: Chun-Te Lee, Taichung City, Taiwan

[73] Assignee: Super Group Co., Ltd., Taichung City, Taiwan

[21] Appl. No.: 752,557

[22] Filed: Nov. 19, 1996

[51] Int. Cl.[6] ..... H01R 9/05; H01R 17/04

[52] U.S. Cl. ..... 439/578

[58] Field of Search ..... 439/63, 578, 581, 439/580

[56] References Cited

U.S. PATENT DOCUMENTS

| | | | |
|---|---|---|---|
| 4,326,769 | 4/1982 | Dorsey et al. | 439/578 |
| 4,674,809 | 6/1987 | Hollyday | 439/580 |
| 4,759,729 | 7/1988 | Kemppainen et al. | 439/581 |
| 4,941,846 | 7/1990 | Guimond et al. | 439/578 |
| 5,548,088 | 8/1996 | Gray et al. | 439/578 |

FOREIGN PATENT DOCUMENTS

| | | | |
|---|---|---|---|
| 0450988 | 10/1991 | France | 439/578 |

*Primary Examiner*—Gary F. Paumen
*Assistant Examiner*—Katrina Davis
*Attorney, Agent, or Firm*—Christie, Parker & Hale, LLP

[57] ABSTRACT

An electrical connector includes a generally cylindrical conductive housing, a conductive cable-engaging member and a hollow, elongated insulating member which is fitted in the conductive housing. The conductive cable-engaging member has an elongated intermediate section, two engaging units extending lengthwise from the ends of the intermediate section, and two first shoulder portions. The insulating member has two closed ends, two receiving spaces for receiving the engaging units of the cable-engaging member, and a restricted space interconnecting the receiving spaces for receiving the intermediate section of the cable-engaging member. Each of the closed ends of the insulating member has a through-hole formed therein. Each of the receiving spaces is adjacent to and communicates with a respective one of the through-holes. The restricted space and each of the receiving spaces have a second shoulder portion formed therebetween for engaging a respective one of the first shoulder portions of the cable-engaging member in order to prevent the cable-engaging member from moving lengthwise relative to the insulating member.

5 Claims, 5 Drawing Sheets

ELECTRICAL CONNECTOR FOR INTERCONNECTING FEMALE AND MALE CONTACTS OF CABLES

BACKGROUND OF THE INVENTION

1. Field of the Invention

This invention relates to an electrical connector, more particularly to a coaxial electrical connector which can be used to interconnect female and male contacts of two cables.

2. Description of the Related Art

Referring to FIG. 1, a conventional electrical connector 10 is shown to comprise a generally cylindrical conductive housing 11 with two externally threaded end portions 113, two tubular insulating members 13 fitted in the conductive housing 11, and a conductive cable-engaging member 12 fitted in the tubular insulating members 13. As illustrated, the cable-engaging member 12 includes two engaging units 122 which are connected by an intermediate bar 121. Each of the engaging units 122 is a female connector which is formed of two V-shaped springs with flared end portions 124. The male contacts, i.e. male pins 141 of two coaxial cables 14, are inserted through open ends 112 of the conductive housing 11 and through-holes 131 in the tubular insulating members 13 so as to be clamped by the engaging units 122.

The conventional electrical connector suffers from the following disadvantages:

1. No positioning means is provided in the insulating members 13 for preventing longitudinal movement of the cable-engaging member 12 relative to the insulating members 13. Therefore, the engaging units 122 of the cable-engaging member 12 are liable to offset from their correct positions relative to the male pins 141 of the coaxial cables 14.
2. The cable-engaging member 12 cannot be used to clamp male and female contacts of two cables.

SUMMARY OF THE INVENTION

It is therefore a main objective of the present invention to provide an electrical connector in which the cable-engaging member 12 can be prevented from moving relative to the insulating member.

Another objective of the present invention is to provide an electrical connector which can be used to interconnect female and male contacts of two cables.

According to the present invention, an electrical connector comprises a generally cylindrical conductive housing, a conductive cable-engaging member and a hollow, elongated insulating member which is fitted in the conductive housing.

The conductive cable-engaging member has an elongated intermediate section, two engaging units extending lengthwise from the ends of the intermediate section, and two first shoulder portions. Each of the first shoulder portions is formed adjacent to a respective one of the ends of the intermediate section.

The insulating member has two closed ends, two receiving spaces for receiving the engaging units of the cable-engaging member, and a restricted space interconnecting the receiving spaces for receiving the intermediate section of the cable-engaging member formed therein. Each of the closed ends of the insulating member has a through-hole formed therein. Each of the receiving spaces is adjacent to and is communicated with a respective one of the through-holes. The restricted space and each of the receiving spaces have a second shoulder portion formed therebetween for engaging a respective one of the first shoulder portions of the cable-engaging member in order to prevent the cable-engaging member from moving lengthwise relative to the insulating member.

In a preferred embodiment, the insulating member has a casing with an open top and a lid hinged to the casing in order to close the open top of the casing. The casing has a bottom wall which is opposite to the open top, and a projection formed on the bottom wall in the restricted space. The lid has an inside face which is formed with a plurality of protrusions. The protrusions and the projection sandwich the intermediate section of the cable-engaging member when the open top is closed by the lid in order to prevent transverse movement of the cable-engaging member relative to the insulating member.

In the preferred embodiment, one of the engaging units is a female connector which is formed of spring arms with flared end portions, while the other one of the engaging units is a male connector which is formed of an elongated pin that extends beyond the insulating member through a corresponding one of the through-holes in the insulating member.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
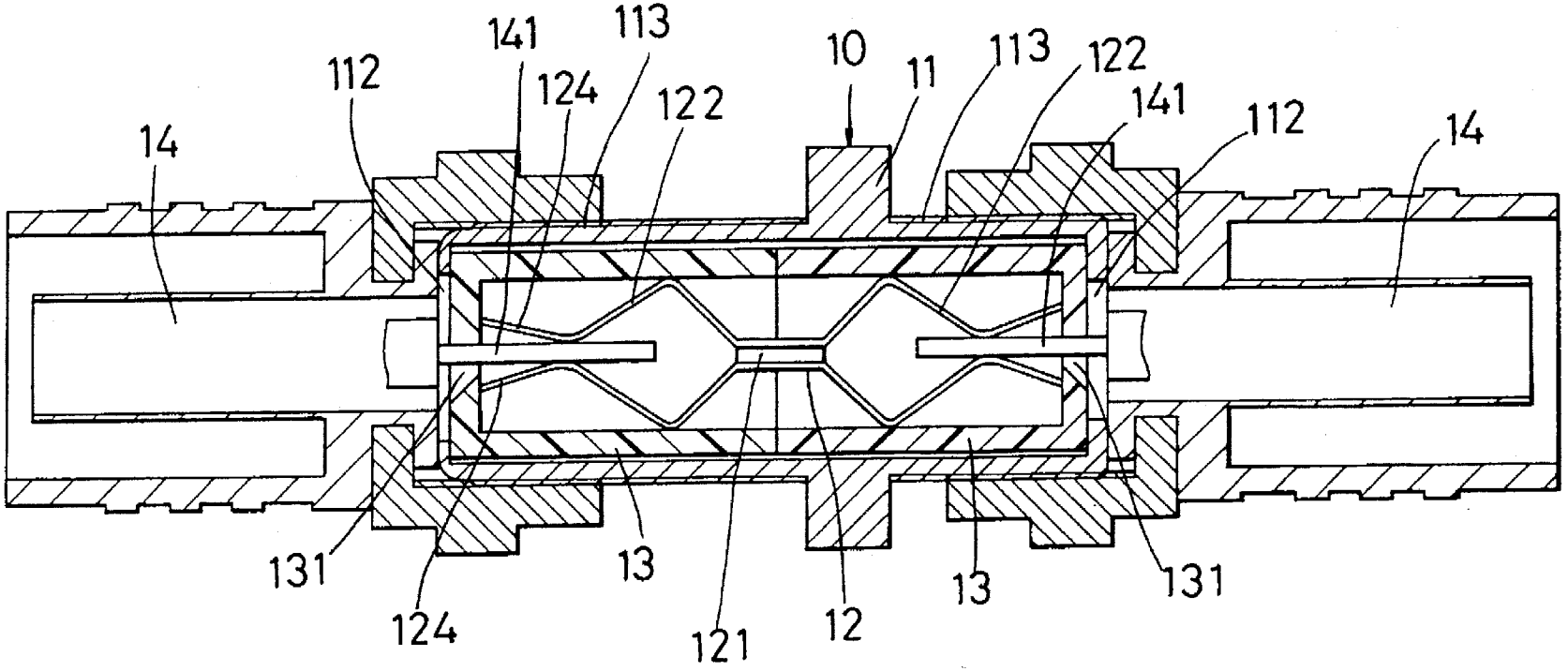
FIG. 1 PRIOR ART
FIG. 1 is a sectional view of a conventional electrical connector.
Figure 2:
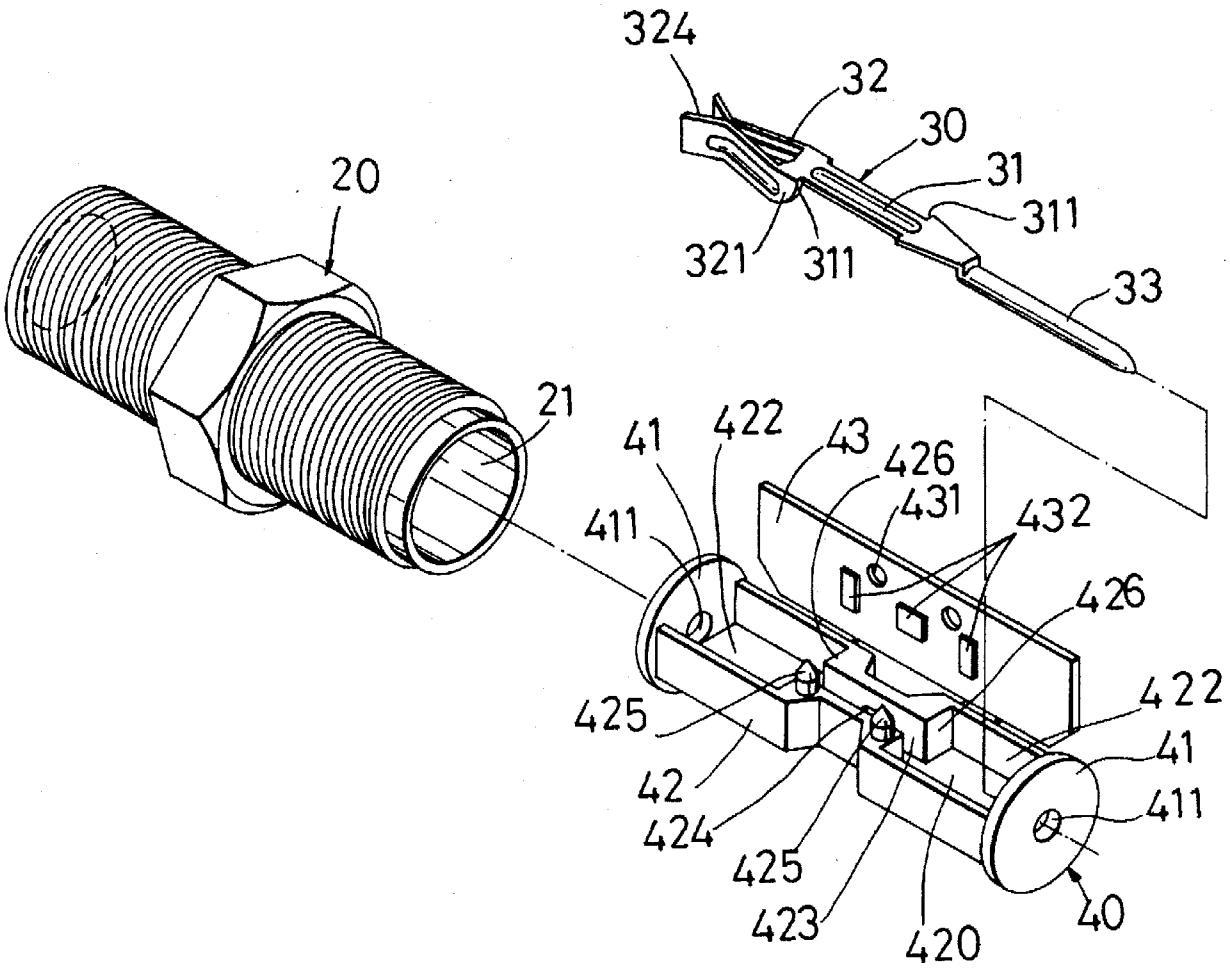
FIG. 2 is an exploded view of a preferred embodiment of an electrical connector according to the present invention.

Referring to FIGS. 2, a preferred embodiment of a coaxial electrical connector according to the present invention comprises a generally cylindrical conductive housing 20, a conductive cable-engaging member 30 and a hollow, elongated insulating member 40 which is fitted in the conductive housing 40 in a known manner.

The conductive cable-engaging member 30 has an elongated intermediate section 31, two engaging units 32, 33 extending lengthwise from the ends of the intermediate section 31, and two first shoulder portions 311. As illustrated, each of the first shoulder portions 311 is formed adjacent to a respective one of the ends of the intermediate section 31.

Figure 4:
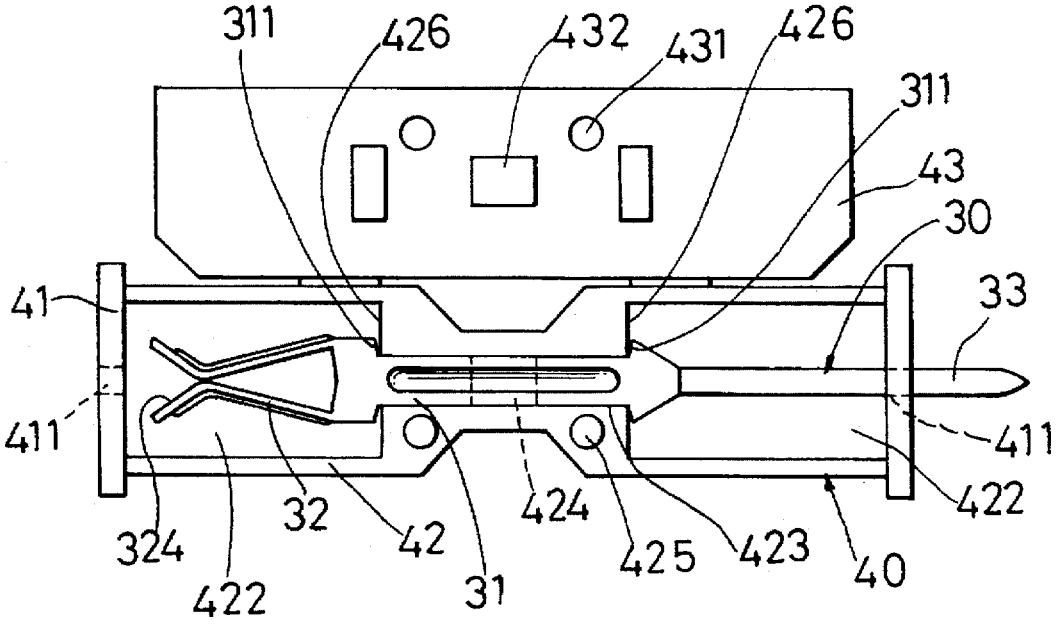
FIG. 4 is a top view of the insulating member and the cable-engaging member of the electrical connector according to the present invention, in which a lid of the insulating member is opened.

The insulating member 40 has a casing 42 with an open top 420, and a lid 43 hinged to the casing 42 in order to close the open top 420 of the casing 42. The lid 43 has two holes 431 formed therein. The casing 42 has two engaging pillars 425 with sharpened ends which are formed adjacent to the open top 420. Each of the engaging pillars 425 are press-fitted into a corresponding one of the holes 431 in the lid 43 in order to retain the lid 43 in a closed position. The insulating member 40 has two circular closed ends 41, two receiving spaces 422 for receiving the engaging units 32, 33 of the cable-engaging member 30, and a restricted space 423 interconnecting the receiving spaces 422 for receiving the intermediate section 31 of the cable-engaging member 30, formed therein. Each of the closed ends 41 of the insulating member 40 has a through-hole 411 formed therein. Each of the receiving spaces 422 is adjacent to and communicates with a respective one of the through-holes 411. The restricted space 423 and each of the receiving spaces 422 have a second shoulder portion 426 formed therebetween for engaging a respective one of the first shoulder portions 311 of the cable-engaging member 30 in order to prevent the cable-engaging member 30 from moving lengthwise relative to the insulating member 40, as best illustrated in FIG. 4.

Figure 3:
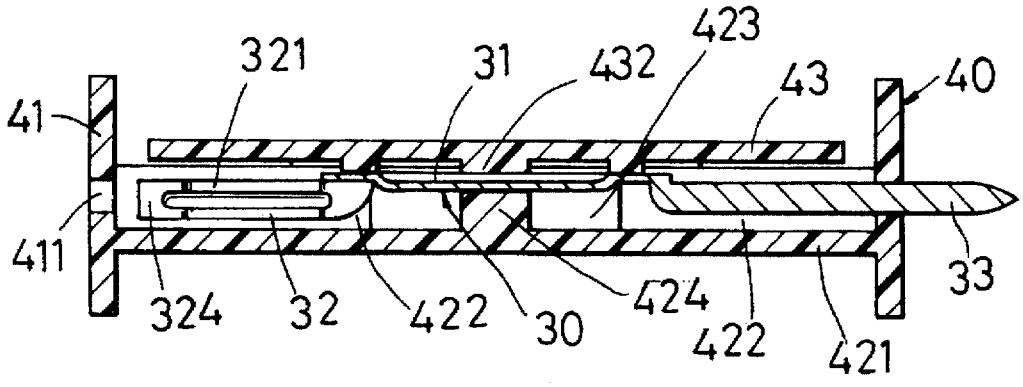
FIG. 3 is a sectional view of an insulating member and a cable-engaging member positioned in the insulating member according to the present invention.

The casing 42 has a bottom wall 421 which is opposite to the open top 420, and a projection 424 formed on the bottom wall 421 in the restricted space 423. The inside face of the lid is formed with a plurality of, such as three, protrusions 432. The protrusions 432 and the projection 424 sandwich the intermediate section 31 of the cable-engaging member 30 when the open top 420 is closed by the lid 43 in order to prevent transverse movement of the cable-engaging member 30 relative to the insulating member 40, as best illustrated in FIG. 3.

Figure 5:
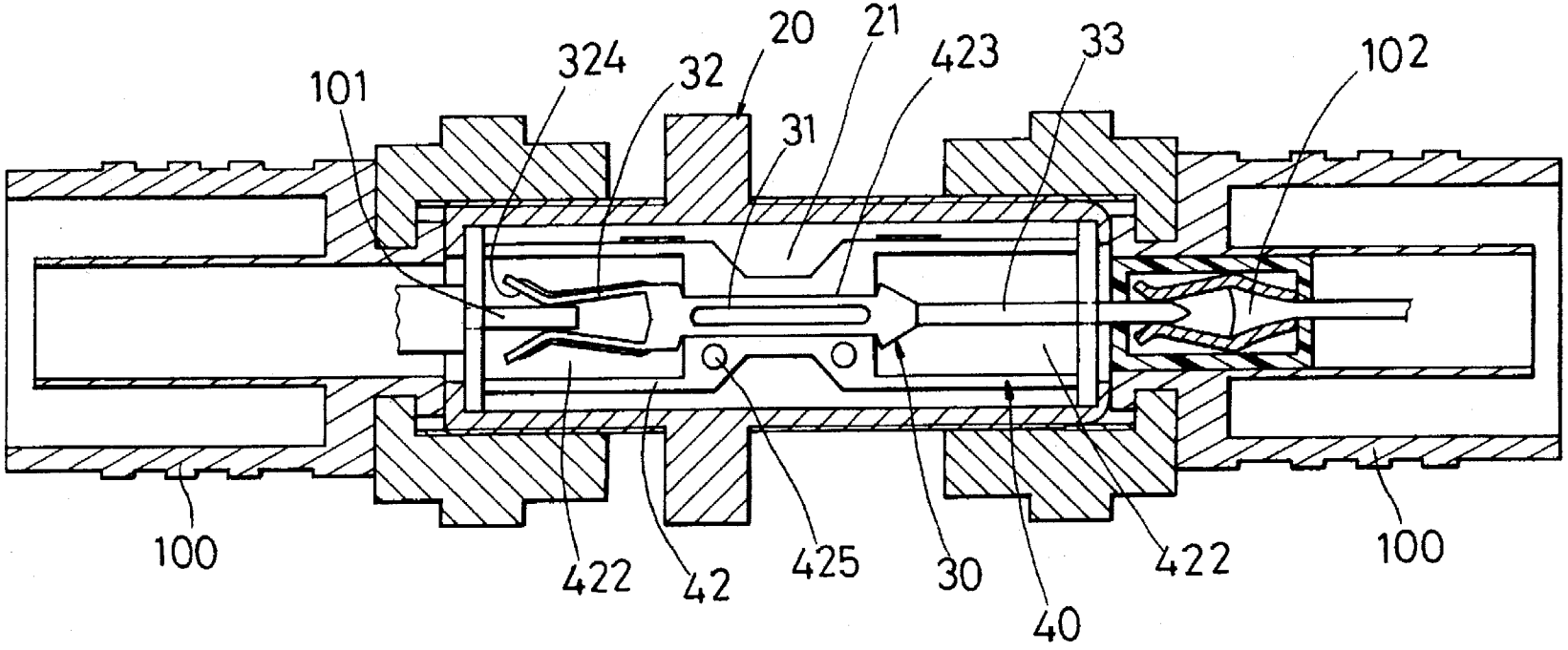
FIG. 5 is a sectional view of the preferred embodiment of the electrical connector according to the present invention.

Referring to FIGS. 2 and 5, one of the engaging units 32 is a female connector which is formed of spring arms 321 with flared end portions 324, while the other one of the engaging units 33 is a male connector which is formed of an elongated pin that extends beyond the insulating member 40 through a corresponding one of the through-holes 411 in the insulating member 40. Therefore, male and female contacts 101, 102 of two cables 100 can be inserted into and clamp onto the engaging units 32 and 33, respectively.

Figure 6:
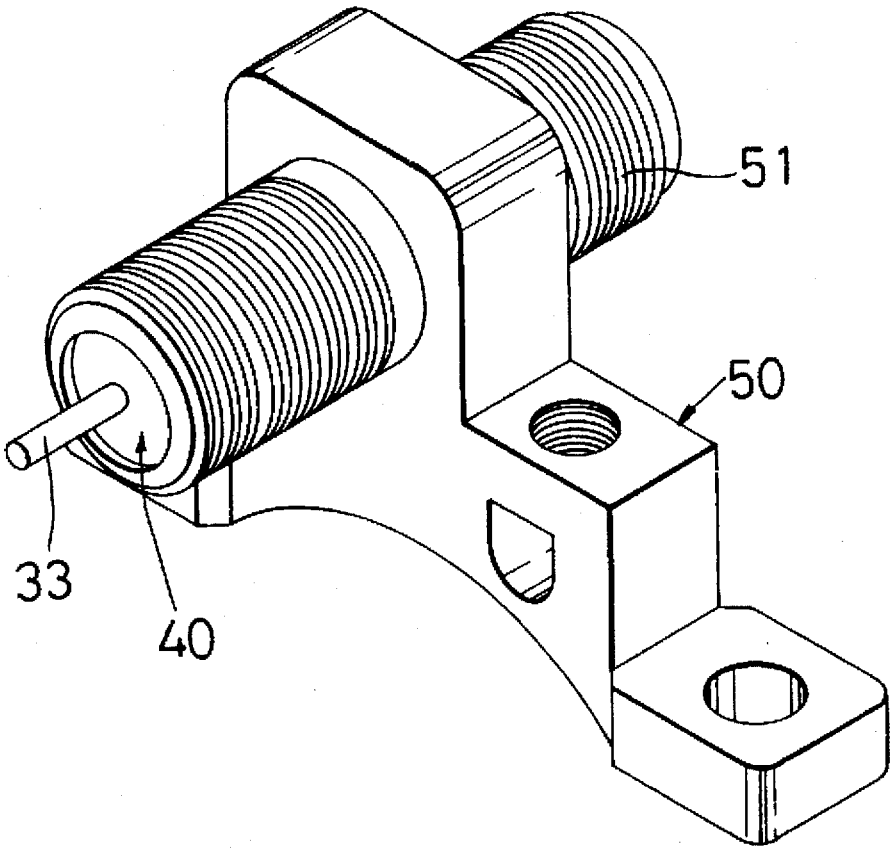
FIG. 6 shows a modified electrical connector of the present invention.

Referring to FIG. 6, a modified preferred embodiment of an electrical connector 51 of the present invention is shown to be fastened to a fixed bracket 54. The insulating member 40 is mounted in the electrical connector 51 in a manner similar to that of the aforementioned embodiment. The fixed bracket 54 can be fastened to a wall or a stationary position in order to prevent wobbling of the electrical connector 51 relative to the cables connected thereto.

It is noted that the cable-engaging member 30 can be positioned stably in the insulating member 40 by means of the first and second shoulder portions 311, 426 and the projection 424 and the protrusions 432 when the electrical connector is in use. In addition, the electrical connector can be used to connect male and female contacts 101, 102. Thus, the objective of the present invention are achieved.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A coaxial electrical connector, comprising:

a generally cylindrical conductive housing;

a conductive cable-engaging member having an elongated intermediate section with two ends, two engaging units extending lengthwise from said ends of said intermediate section, and two first shoulder portions, each of said first shoulder portions being formed adjacent to a respective one of said ends of said intermediate section; and a hollow, elongated insulating member fitted in said conductive housing and having two closed ends, two receiving spaces for receiving said engaging units of said cable-engaging member, and a restricted space interconnecting said receiving spaces for receiving said intermediate section of said cable-engaging member, each of said closed ends of said insulating member having a through-hole formed therein, each of said receiving spaces being adjacent to and communicating with a respective one of said through-holes, said restricted space and each of said receiving spaces having a second shoulder portion formed therebetween for engaging a respective one of said first shoulder portions of said cable-engaging member in order to prevent said cable-engaging member from moving lengthwise relative to said insulating member.

2. The coaxial electrical connector as claimed in claim 1, wherein said insulating member has a casing with an open top and a lid hinged to said casing in order to close said open top of said casing.

3. The coaxial electrical connector as claimed in claim 2, wherein said casing has a bottom wall which is opposite to said open top, and a projection formed on said bottom wall in said restricted space, said lid having an inside face which is formed with a plurality of protrusions, said protrusions and said projection sandwiching said intermediate section of said cable-engaging member when said open top is closed by said lid in order to prevent said cable-engaging member from moving transversely relative to said insulating member.

4. The coaxial electrical connector as claimed in claim 2, wherein said lid has two holes formed therein, said casing having two engaging pillars formed adjacent to said open top, each of said engaging pillars being press-fitted into a corresponding one of said holes in said lid.

5. The coaxial electrical connector as claimed in claim 1, wherein one of said engaging units is a female connector which is formed of spring arms with flared end portions, the other one of said engaging units being a male connector which is formed of an elongated pin that extends beyond said insulating member through a corresponding one of said through-holes of said insulating member.

* * * * *